US006397393B2

(12) United States Patent
Alger

(10) Patent No.: US 6,397,393 B2
(45) Date of Patent: Jun. 4, 2002

(54) CLOTHING COMBINATION COMPRISING A SELF-RELEASING BONDING MEANS

(76) Inventor: Fred Alger, 75 Maiden La., New York, NY (US) 10038

( * ) Notice: Subject to any disclaimer, the term of this patent is extended or adjusted under 35 U.S.C. 154(b) by 0 days.

(21) Appl. No.: 09/733,056

(22) Filed: Dec. 11, 2000

Related U.S. Application Data

(63) Continuation of application No. 09/066,842, filed on Apr. 28, 1998, now Pat. No. 6,185,745.

(51) Int. Cl.[7] ..... A41D 1/18

(52) U.S. Cl. ..... 2/107; 2/69; 2/227; 2/914; 24/304

(58) Field of Search ..... 2/107, 112–114, 2/79, 78.1–3, 69, 71, 72, 75–76, 78.4, 80, 83, 914, 920, 227, 269, 270; 24/304, 306

(56) References Cited

U.S. PATENT DOCUMENTS

| | | | | | |
|---|---|---|---|---|---|
| 2,104,487 | A | * | 1/1938 | Kessler | 2/69 |
| 2,180,346 | A | * | 11/1939 | Brewster | 2/69 |
| 2,390,462 | A | * | 12/1945 | Rosenberg | 2/69 |
| 4,004,297 | A | * | 1/1977 | Polack | 2/227 |
| 4,941,237 | A | * | 7/1990 | Hovis | 24/304 |
| 5,123,120 | A | * | 6/1992 | Ross | 2/229 |
| 5,182,812 | A | * | 2/1993 | Goldsby | 2/79 |
| 5,309,608 | A | * | 5/1994 | Lucas | 24/304 |
| 5,343,564 | A | * | 9/1994 | Reynolds et al. | 2/70 |
| 5,343,565 | A | * | 9/1994 | Berni | 2/79 |
| 5,515,544 | A | * | 5/1996 | Hosking | 2/107 |
| 5,786,062 | A | * | 7/1998 | Callahan, Jr. et al. | 428/100 |
| 5,888,335 | A | * | 3/1999 | Kobe et al. | 156/306.3 |
| 5,913,480 | A | * | 6/1999 | Luhmann et al. | 24/304 |
| 6,233,352 | B1 | * | 5/2001 | Watlington | 2/80 |

OTHER PUBLICATIONS

Fabrics used by OR, Internet Article, pg. 4 of 5, www.orgear.com May 16, 1999.*

* cited by examiner

*Primary Examiner*—John J. Calvert
*Assistant Examiner*—Katherine Moran
(74) *Attorney, Agent, or Firm*—Dorsey & Whitney LLP

(57) ABSTRACT

This invention relates to a clothing combination comprising a shirt and a pair of pants wherein the shirt and the pair of pants are fastened together by a self-releasing bond. Preferably, the bond is made using hook strips and loop strips that, in combination, form a hook and loop fastener. The self-releasing bond separates in a reformable manner when subjected to severe tensile strength or shear strength but has sufficient flexibility and bond strength to enable the clothing combination to be useful in sporting activities. Multicomponent kits and processes of making the same are disclosed.

36 Claims, 12 Drawing Sheets

CLOTHING COMBINATION COMPRISING A SELF-RELEASING BONDING MEANS

This application is a continuation of U.S. patent application Ser. No. 09/066,842, filed Apr. 28, 1998, now U.S. Pat. No. 6,185,745.

FIELD OF THE INVENTION

This invention relates to a clothing combination comprising a shirt and a pair of pants wherein the shirt and the pair of pants are fastened together by a self-releasing bond. More particularly, this invention relates to a clothing combination that comprises a shirt and a pair of pants fastened together by at least one hook and loop fastening mechanism.

BACKGROUND

In the art of dress clothing, which includes both business and formal wear, appearance is a principal factor governing consumer selection. Successful products must remain taught over the body to convey professionalism. At the same time, successful products do not exaggerate, and hopefully alleviate, physical imperfections of the wearer, such as an expansive stomach. This is a delicate balance that is difficult to achieve.

In example, if one has an expansive stomach, it is desirable to firmly attach a shirt to a pair of pants at or near the region of the belly button. However, securing a pair of pants this high on the wearer is problematic using conventional fasteners such as belts. Gravity and the natural pulling forces of the lower body in motion pull the belt down to the wearer's waist. Additionally, no matter how tightly the belt is secured, the shirt eventually crepes out of the pants and requires retucking.

Appearance is also a major concern in the art of sports clothing. However, in the art of sports clothing comfort is equally important in swaying consumers to choose one set of garments over another. Because comfort plays such a critical role in purchaser selection, fastening devices that attach sport shirts to sport pants are considered undesirable. In example, it is generally accepted that belts constrict an athletes flexibility and, therefore, sport pants are not sold with belts and do not generally contain belt loops.

However, despite the deficiency of belts as fasteners in both the dress clothing art and the sports clothing art, acceptable alternatives, to date, have not been apparent. Fastening devices other than belts are considered undesirable for use in attaching a shirt and pair of pants because the devices do not self-release in a reusable manner when subjected to a tensile or shearing force strong enough to tear one of the garments. Instead the fastening devices rip away. Even worse, because the fastening devices are sewn into the garments, the garments can be torn when the fastening devices rip away. In example, hooks, buttons and zippers do not self-release in a manner that leaves them reusable when they are subjected to a tensile or shearing force strong enough to rip the garments. Instead hooks, buttons and zippers rip away, rendering the fastening device useless and often tearing the garments in the process.

Snaps can self-release in a reusable manner when subjected to a tensile or shearing force strong enough to rip the garments, but only when said force is at an appropriate angle. Otherwise, as with hooks, buttons and zippers, the snaps and surrounding material tear away. More importantly, snaps have the disadvantage of providing a weak attachment that is easily undone by the small vibrational forces inherent to physical exertion.

In addition, the metal materials from which most snaps and many buttons and zippers are made are not water and chemical resistant. As a result the fasteners rust and become unsightly.

Finally, all of the previously mentioned fastening devices are made from hard plastic or metal materials that are not readily dyeable in the same dying step and by the same dying means as the garments. Fastening devices must be colored separately, by using paint, colored fillers, or some other means, in a manner that matches the garment to which they are to be attached. Otherwise, the fastening devices are readily apparent to the viewer and detract from the overall appearance of the garment.

For all of the above stated reasons, the art teaches away the use of fasteners other than belts to secure a shirt to a pair of pants. However, it would still be desirable to fasten a shirt to a pair of pants if a suitable fastening means could be found. Fastening a shirt and pair of pants together, whether by means of suspenders or belts or some other device, has long been recognized as the ideal way to maintain the ideal aesthetic appearance of the garments. This is especially true when the shirt is tucked taught into the pair of pants. In fact, the NBA now requires its athletes to keep their uniform shirts tucked into their uniform pants at all times. Other professional and amateur sports associations may have or adopt similar rules. Furthermore, in the business community, it goes without saying that dress shirts are always tucked into suit or dress pants. In addition, fastening the shirts and pants together provides a means of controlling the manner in which the garments relax, thereby allowing the manufacturer, or the wearer, to tailor the fall of the garments in a manner deemed most comfortable and most suitable for a given physical activity.

What is needed is a better way to fasten a shirt to a pair of pants.

What is needed is a means for fastening a shirt to a pair of pants in a taught manner that does not call attention to the physical imperfections of the wearer.

What is needed is a means for fastening a shirt to a pair of pants that does not restrict flexibility.

What is needed is a means for fastening a shirt to a pair of pants that self-releases in a reusable manner when subjected to a tensile or shearing force strong enough to rip one of the garments.

What is needed is a means for fastening a shirt to a pair of pants that is not easily undone by the small vibrational forces inherent to physical exertion.

What is needed is a means for fastening a shirt to a pair of pants that is water and chemical resistant.

What is needed is a means for fastening a shirt to a pair of pants that is readily dyeable in the same dying step as the fabric.

SUMMARY OF THE INVENTION

In the early 1940's, Swiss inventor George de Mestral went on a walk with his dog and noticed that both his pants and his dog returned covered with cockle burrs. His curiosity led him to view the burrs under a microscope whereupon he discovered that they contained a natural hook-like shape. The hook-like shape easily clung to the woven loops in his nylon pants and the tangled hairs on his dog. This became the basis for a unique two-sided fastener—one side of which contains stiff hooks, like the burrs, and the other side of which contains soft loops, like the fabric of the pants and tangled hairs of the dog. Mestral decided to market this new hook and loop fastening system under the name VELCRO™ taken from the french words "velour," meaning velvet, and "crochet," meaning hook. Today there are many companies which produce this type of fastening system, called a hook and loop fastener or a touch fastener. However, VELCRO™ produced by Velcro Industries B.V. remains the most prominent product.

Hook and loop fasteners have been used in the clothing industry for a variety of purposes. In example, hook and loop fasteners have been used as an alternative to shoe laces. In further example, hook and loop fasteners have been used as a means for attaching articles to sport clothing, such as attaching hand towels to baseball uniforms so that athletes can remove sweat without coming in from the field.

For a variety of reasons, Hook and loop fasteners are an ideal way to attach a pair of pants to a shirt. For example, the material make-up of hook and loop fasteners does not restrict flexibility. Hook and loop fasteners are typically made out of nylon and/or polyester polymers. These polymers are often used to make clothing and bend in the same manner as clothing. Thus hook and loop fasteners are flexible.

In addition, hook and loop fasteners can be made small enough to minimize inflexibility due to the size of the fastener. In fact, an effective bond can be made from a hook and loop fastener that has a thickness, width and length, as little as ½" or even less. The narrow thickness is especially important in lessening the chances that the fastener will hinder movement.

Hook and loop fasteners are adjustable by manipulating the size and location of the surface area wherein the hook and loop strips contact. Therefore, if a hindrance to movement occurs, the fastener can be adjusted to minimize the hindrance.

Most importantly, the bonds provided by hook and loop fasteners self-release in a reusable manner when subjected to a tensile and/or shearing forces strong enough to tear one of the garments. The hook strips and loop strips pull apart but remain unbroken, allowing later contact to reform the self-releasing bond. This allows the shirt and/or pant maximum movement when subjected to severe forces and, thereby, minimizes the chances that the shirt and/or pair of pants will tear. As stated, this is not the case with existing shirt-pants fastening means, such as buttons, hooks and zippers.

However, the bonds provided by hook and loop fasteners are also capable of withstanding the small vibrational forces inherent to physical exertion. In fact, such vibrational forces actually increase the strength of the bond because it causes the hooks to move deeper into the loop entanglements. This makes hook and loop fasteners a vast improvement over snaps.

In addition, hook and loop fasteners are made of nylon and/or polyester. Both nylon and polyester are water resistant, chemical resistant and dyeable using conventional clothing dyes. Thus hook and loop fasteners do not rust and are readily dyeable in the same dying step and by the same manner as the pair of pants and/or shirt.

Utilizing hook and loop fasteners, a shirt, such as a dress shirt, can be tucked taught inside a pair of pants, such as a pair of suit pants; without creping out and requiring retucking. The hook and loop fasteners, because they are sewn into the clothing can be firmly affixed above the waistline at or near the belly button to enable a wearer to present a neat appearance that, simultaneously, hides physical imperfections such as an expansive stomach.

Thus the use of hook and loop fasteners to attach a shirt to a pair of pants gives all of the aesthetic and control benefits of a fastening device without any of the drawbacks typically encountered when the clothes are worn by the modern day businessman, businesswoman and athlete.

A clothing combination has been created comprising a pair of pants and a shirt that are bound together in a taught manner using a self-releasing bond such as the bond created using hook and loop fasteners. The clothing combination has the flexibility, vibration strength, and weather resistance needed to serve the needs of the business and sporting communities.

The clothing combination comprises a pair of pants having front and back side, an inner and outer surface, a pant waistline, a waistband that encompasses the pant waistline, and one or more pant connecting strips affixed to the waistband. The clothing combination also includes a shirt having a front and back side, an inner and outer surface, a shirt waistline, a waist zone that encompasses the shirt waistline and one or more shirt connecting strips affixed to the waist zone. The pant and shirt are connected, or capable of being connected, through self-releasing bonds that are formed whenever said pant connecting strips are brought into contact with said shirt connecting strips.

In addition, the instant invention embraces multicomponent kits for making said clothing combination. The first multicomponent kit comprises a pair of pants or a shirt with preattached connecting strips, unaffixed adhesive connecting strips and, optionally one or more templates. The second multicomponent kit comprises several unaffixed adhesive connecting strips and one or more templates. In both kits, the templates guide the wearer in applying the unaffixed adhesive connecting strips to create a clothing combination that can be bound together with a self-releasing bond.

Finally, the instant invention is to a process for making said clothing combination.

It is an object of this invention to provide an improved means for fastening a shirt to a pair of pants.

It is an object of this invention to provide a means for fastening a shirt to a pair of pants in a taught manner that does not call attention to the physical imperfections of the wearer.

It is an object of this invention to provide a means for fastening a shirt to a pair of pants that does not hinder flexibility.

It is an object of this invention to secure a shirt to a pair of pants by a means that self-releases in a reusable manner when subjected to a tensile or shearing force strong enough to rip one of the garments.

It is an object of this invention to produce a means for fastening a shirt to a pair of pants that is not easily undone by the small vibrational forces inherent to physical exertion.

It is an object of this invention to provide a means for fastening a shirt to a pair of pants that is water and chemical resistant.

It is an object of this invention to secure a shirt to a pair of pants by a means that is readily dyeable in the same dying step as the shirt and/or pair of pants.

DESCRIPTION OF THE PREFERRED EMBODIMENTS

Figure 1A:
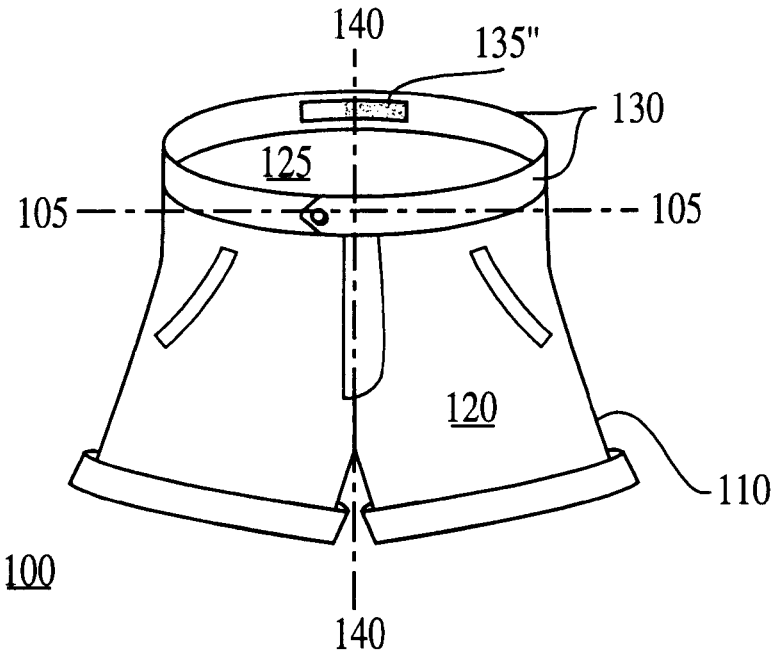
FIG. 1 is a diagram of the primary components in one embodiment of the inventive pair of pants.
Figure 1B:
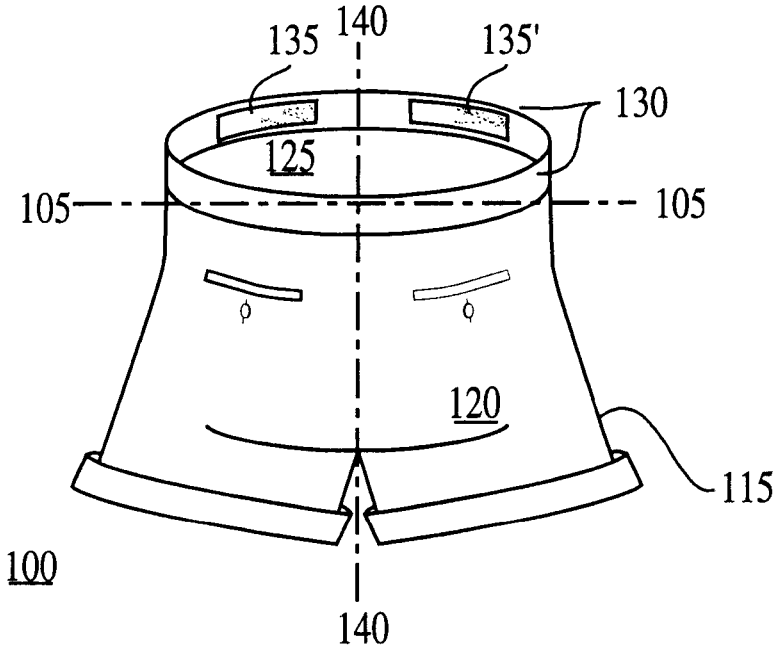

FIG. 1 shows a sample pair of pants 100 for use in the instant invention. As used in this application the words "pant" and "pants," and the phrase "pair of pants," mean any pair of pants, pair of shorts, dress, skirt, or any other garment that would generally cover the lower torso of a wearer. Nonlimiting examples of acceptable pants include dress pants, sport pants, suit pants, casual slacks and jeans.

The pair of pants 100 has a front side 110 that covers the front of the wearer. The front side 110 is shown in the figure with a button, a zipper and two front pockets. The front side 110 has an outer surface 120 and an inner surface 125 and is symmetrically positioned around a central vertical axis 140. The front side 110 contains a pant waistline 105 shown as an imaginary horizontal line. The pant waistline 105 marks the location where the pair of pants 100 is supposed to contact the wearer's waist, assuming that the wearer's pant size is identical to the size marked on the pair of pants 100. The pant waistline 105 and a region that starts approximately 3" above the pant waistline 105 and ends approximately 1.5" below the pant waistline 105, and any material thereon or therein, constitute the waistband 130. Within the region that constitutes the waistband 130, two front pant connecting strips 135' are symmetrically positioned and affixed to the inner surface 125 of the front side 110 of the pair of pants 100.

Located behind the front side 110 on the same central vertical axis 140 is a back side 115 that covers the back of the wearer. The back side 115 is attached at the vertical edges to the front side 110. The back side 115 is shown in the figure with two back pockets. The back side 115 has an outer surface 120 and an inner surface 125. The back side 115 also contains the aforementioned pant waistline 105 and waistband 130. Within the region that constitutes the waistband 130, one back pant connecting strip 135" is centrally positioned and affixed to the inner surface 125 of the back side 115 of the pair of pants 100.

Alternatively, the total number of pant connecting strips 135 can be less than or greater than three. Any number of pant connecting strips 135 will suffice as long as at least one pant connecting strip 135 is employed. Furthermore, the pant connecting strips 135 can be positioned in any manner. For instance, an acceptable alternative embodiment would include the use of two pant connecting strips—one on each side of the pair of pants.

The pant connecting strips 135 are preferably made from a noncorrosive material that can be dyed with conventional clothing dyes. Such materials include nylon and/or polyester. Methods of affixing the pant connecting strips 135 to the pair of pants 100 include sewing and the use of adhesives such as pressure and/or heat sensitive adhesives.

Figure 2A:
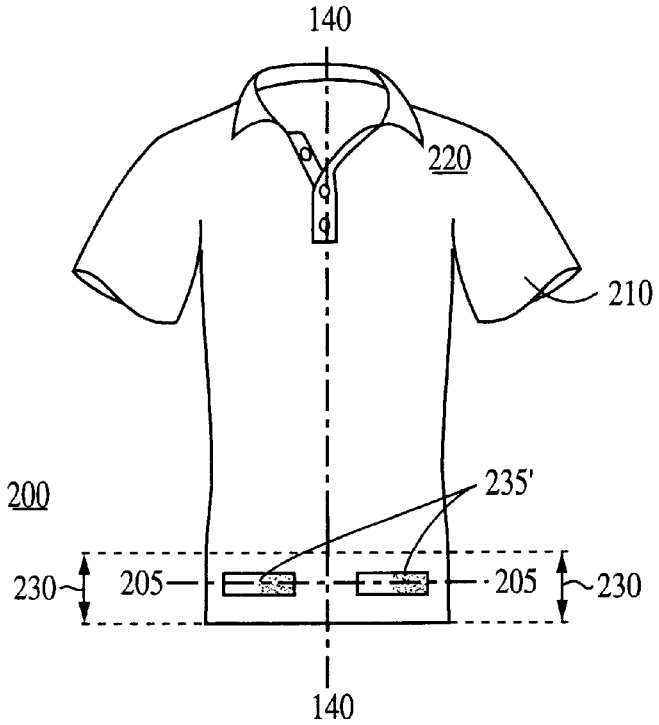
FIG. 2 is a diagram of the primary components in one embodiment of the inventive shirt.
Figure 2B:
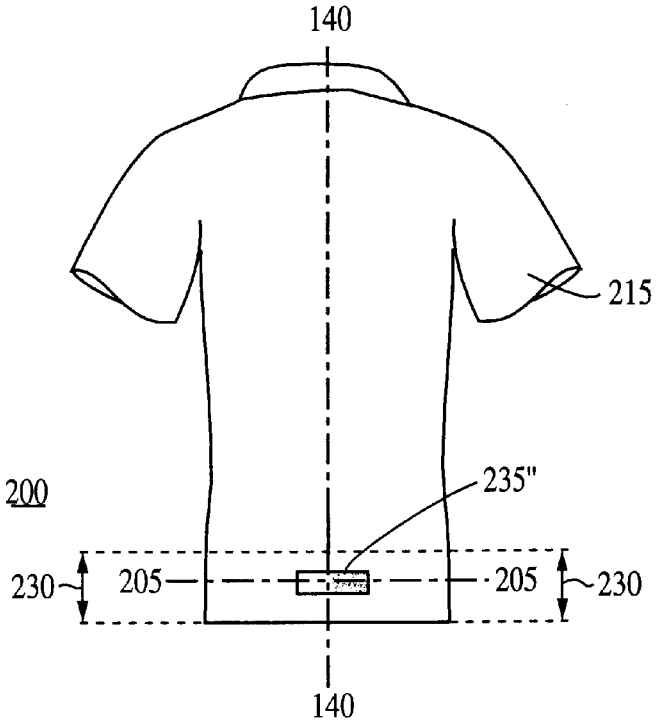

FIG. 2 shows a sample shirt 200 for use in the instant invention. As used in this application the words "shirt" and "shirts" mean any shirt, blouse, or any other garment that would generally cover the upper torso of a person. Nonlimiting examples of acceptable shirts include dress shirts and t-shirts.

The shirt 200 has a front side 210 that covers the front of the wearer. The front side 210 is shown in the figure with an open collar containing a button. The front side 210 has an outer surface 220 and an inner surface 225 and is symmetrically positioned on a central vertical axis 140. The front side 210 contains a shirt waistline 205 shown as an imaginary horizontal line. The shirt waistline 205 marks where the shirt 200 is supposed to contact the wearer's waist, assuming the wearer's shirt size is identical to the size marked on the shirt 200. The shirt waistline 205 and a region that starts approximately 3" above the shirt waistline 205 and ends approximately 1.5" below the shirt waistline 205, and any material thereon or therein, constitute the waist zone 230. Within the waist zone 230, two front shirt connecting strips 235' are symmetrically positioned and affixed to the outer surface 220 of the front side 210 of the shirt 200.

Located behind the front side 210 on the same central vertical axis 140 is a back side 215 that covers the back of the wearer. The back side 215 is attached at the vertical edges to the front side 210. The back side has an outer surface 220 and an inner surface 225. The back side 215 also contains the aforementioned shirt waistline 205 and waist zone 230. Within the region that constitutes the waist zone 230, one back shirt connecting strip 235" is centrally positioned and affixed to the outer surface 220 of the back side 215 of the shirt 200.

Alternatively, the total number of shirt connecting strips 235 can be less than or greater than three. Any number of shirt connecting strips 235 will suffice as long as at least one shirt connecting strip 235 is employed. For instance, an acceptable alternative embodiment would include the use of two shirt connecting strips—one on each side of the shirt.

The shirt connecting strips 235 are preferably made from a noncorrosive material that can be dyed with conventional clothing dyes. Such materials include nylon and/or polyester. Methods of affixing the shirt connecting strips 235 to the shirt 200 include sewing and the use of adhesives such as pressure and/or heat sensitive adhesives.

Figure 3B:
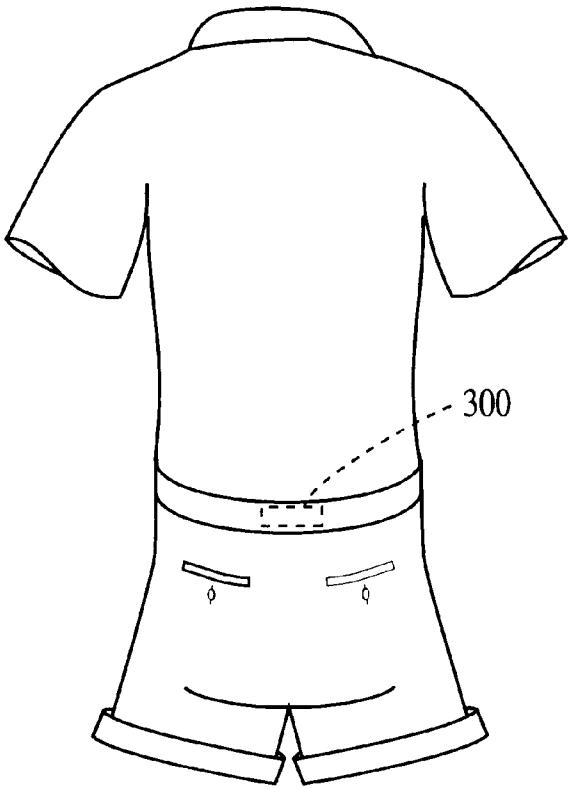
FIG. 3 is an illustration of the pair of pants in combination with the shirt.
Figure 3A:
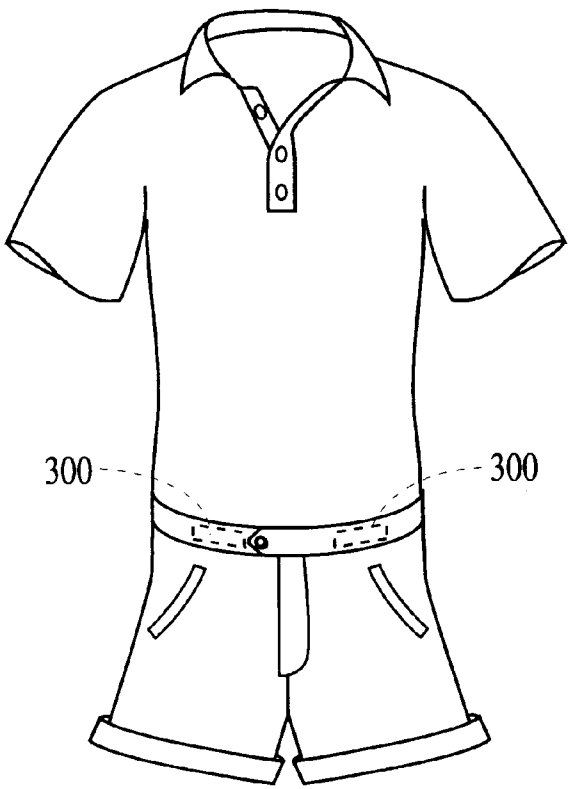

FIG. 3 shows the shirt 200 of FIG. 2 in combination with the pair of pants 100 of FIG. 1. In FIG. 3, the shirt connecting strips 235 on the shirt 200 have been brought into contact with the pant connecting strips 135 on the pair of pants 100 by tucking the shirt 200 into the pair of pants 100. As a result of this contact, self-releasing bonds 300 are formed by the connecting strips that bind the shirt 200 to the pair of pants 100.

The term "self-releasing bond," as used in this application, refers to any bond that meets the following criteria: (1) the bond releases automatically when subjected to a force below the tensile strength of the pair of pants 100 and/or the shirt 200; (2) the bond releases automatically when subjected to a force below the shear strength of the pair of pants 100 or the shirt 200; and (3) the bond releases in a manner that leaves the pant connecting strips 135 and the shirt connecting strips 235 undamaged and capable of forming new bonds. Preferably, each self-releasing bond 300 has a tensile strength between 4 psi and 34 psi and a longitudinal shear strength between 5 psi and 40.5 psi. The self-releasing bonds 300 are formed when a connecting means of the pant connecting strips 135 contacts a connecting means on the shirt connecting strips 235. The connecting means may be an adhesive, such as a pressure sensitive adhesive, or hooks and loops to a hook and loop fastening device.

The self releasing bond 300 in this process is adjustable by manipulating the size and location of the surface area wherein the pant connecting strips 135 and the shirt connecting strips 235 come into contact. However, it is preferred that the surface area wherein the pant connecting strips 135 and the shirt connecting strips 235 come into contact remains at its maximum. Lowering the surface area naturally lowers the strength of the bond. However, lowering the surface area does not affect the self-releasing nature of the bond.

Figure 4A:
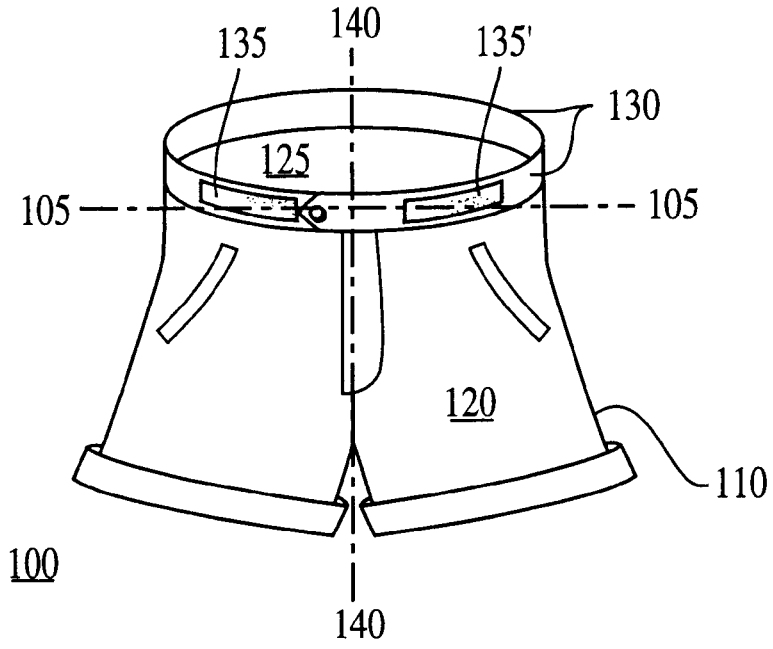
FIG. 4 is a diagram of the primary components in an alternative embodiment of the pair of pants.
Figure 4B:
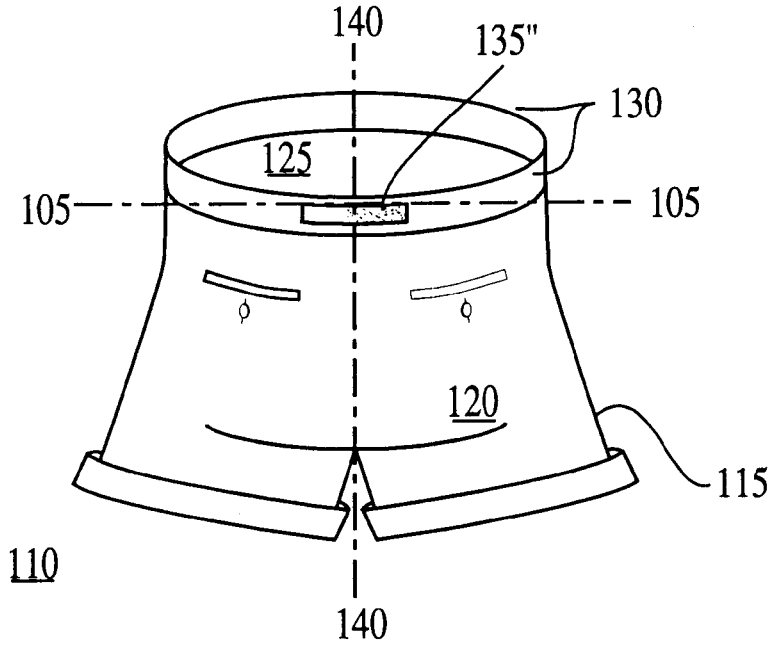

FIG. 4 shows a pair of pants 100 symmetrically positioned around a central vertical axis 140 that, as in FIG. 1, has a front side 110, a back side 115, an outer surface 120 and a inner surface 125. The front side 110 and the back side 115 are horizontally partitioned by a pant waistline 105. The pant waistline 105 is shown as an imaginary line and indicates the location where the pair of pants 100 should contact the wearer's waist, assuming that the wearer's pant size is the same as the size marked on the pair of pants 100. The pant waistline 105 and a region that starts approximately 3" above the pant waistline 105 and ends approximately 1.5" below the pant waistline 105, and any material thereon or therein, constitute the waistband 130. In the area that constitutes the waistband 130, two front pant connecting strips 135' are symmetrically affixed to the front side 110 and one back pant connecting strip 135" is centrally affixed to the back side 115 of the pair of pants 100. The pair of pants 100 shown in FIG. 4 differs from that shown in FIG. 1 in that the three pant connecting strips 135 are affixed to the outer surface 120, rather than the inner surface 125 of the pair of pants 100.

Figure 5A:
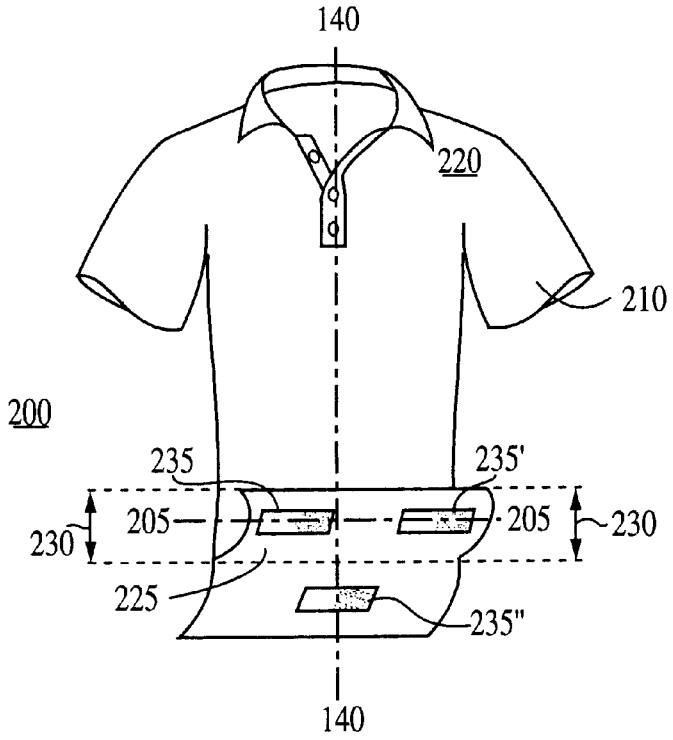
FIG. 5 is a diagram of the primary components in an alternative embodiment of the inventive shirt.
Figure 5B:
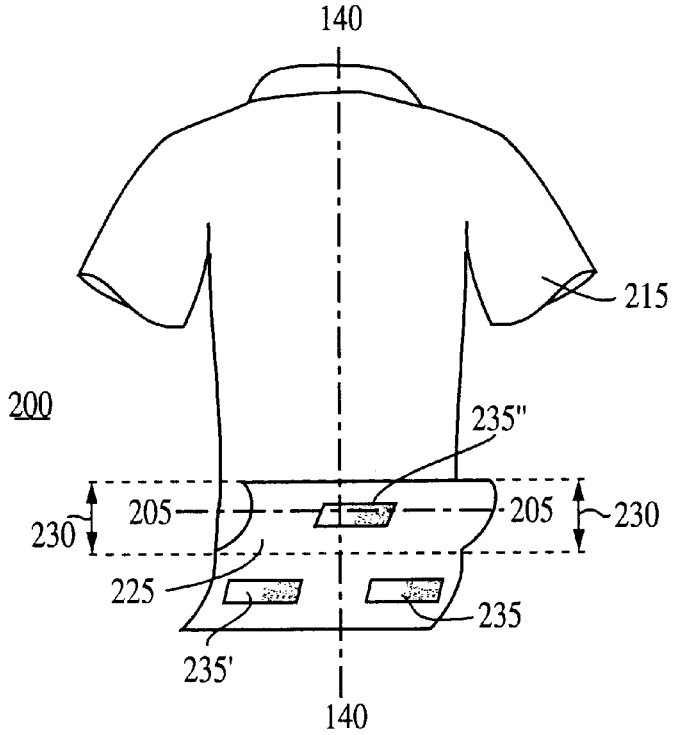

FIG. 5 shows a shirt 200 symmetrically positioned around a central vertical axis 140 that, as in FIG. 2, has a front side 210, a back side 215, an outer surface 220 and an inner surface 225. The front side 210 and the back side 215 are horizontally partitioned by a shirt waistline 205. The shirt waistline 205 is shown as an imaginary line and indicates the location where the shirt 200 should contact the wearer's waist, assuming that the shirt size is the same as the size marked on the shirt 200. The shirt waistline 205 and a region that starts approximately 3" above the shirt waistline 205 and ends approximately 1.5" below the shirt waistline 205, and any material thereon or therein, constitute the waist zone 230. In the area that constitutes the waist zone 230, two front shirt connecting strips 235' are symmetrically affixed to the front side 210 and one back shirt connecting strip 235" is centrally affixed to the back side 215 of the shirt 200. The shirt 200 shown in FIG. 5 differs from that shown in FIG. 2 in that the three shirt connecting strips 235 are affixed to the inner surface 225, rather than the outer surface 220 of the shirt 200.

Figure 6B:
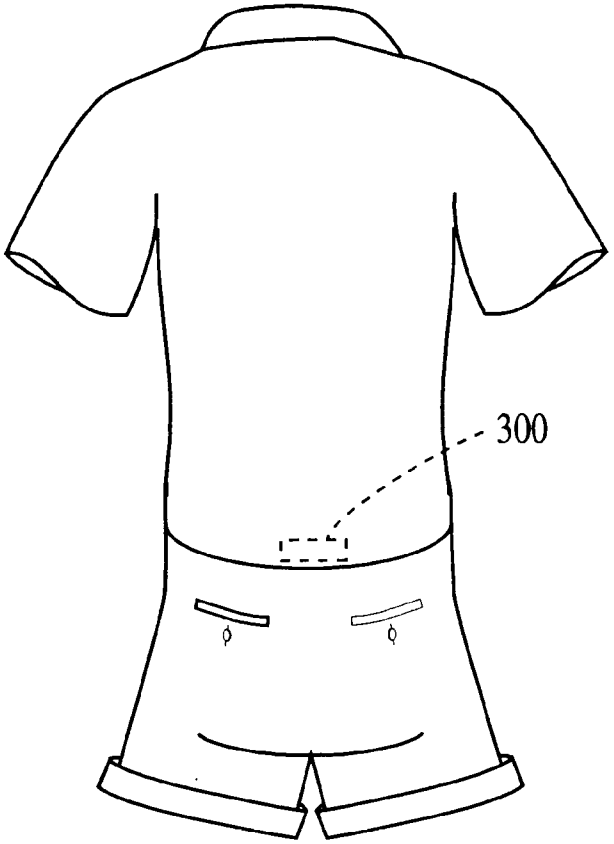
FIG. 6 is an illustration of the pair of pants in combination with the shirt.
Figure 6A:
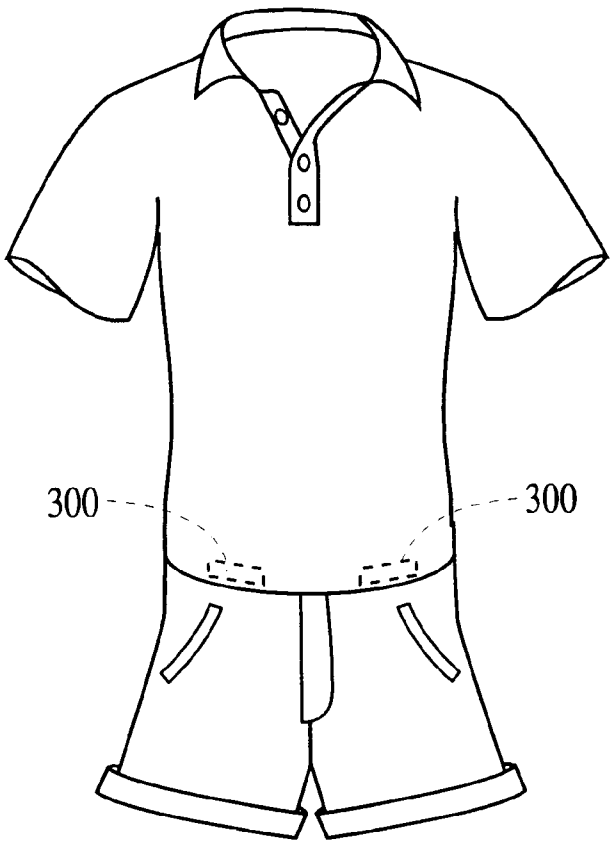

FIG. 6 shows the shirt 200 of FIG. 5 in combination with the pair of pants 100 of FIG. 4. In FIG. 6, the shirt connecting strips 235 on the shirt 200 have been brought into contact with the pant connecting strips 135 on the pair of a pants 100. This contact can occur naturally by allowing the shirt 200 to fall over the pair of pants 100 or can be forced by pressing the shirt 200 against the pair of pants 100. As a result of this contact, self-releasing bonds 300 form that bind the shirt 200 to the pair of pants 100.

As can be seen in both FIG. 3 and FIG. 6, the pant connecting strips 135 can lie on either the outer surface 120 or the inner surface 125 of the pair of a pants 100 and the shirt connecting strips 235 can lie on either the outer surface 220 or the inner surface 225 of the shirt 200. However, in all of the embodiments of this invention, a pant connecting strip 135 cannot lie on the outer surface 120 of the pair of a pants 100 when its corresponding shirt connecting strip 235 lies on the outer surface 220 of the shirt 200. Similarly, a pant connecting strip 135 cannot lie on the inner surface 125 of the pair of pants 100 when its corresponding shirt connecting strip 235 lies on the inner surface 235 of the shirt 200. Because the corresponding pant connecting strips 135 and shirt connecting strips 235 are on opposing surfaces, the connecting strips are able to connect and form the self-releasing bonds 300. It is preferable that the pant connecting strips 135 lie on the inner surface of the waistband 130 and that the shirt connecting strips 235 lie on the outer surface of the waistzone 230 so that they bind the shirt 200 into the pair of pants 100 in the more aesthetically pleasing tucked position. In this tucked configuration the fasteners are covered by the clothing and not seen by an observer.

As stated, the number of pant connecting strips 135 and shirt connecting strips 235 is not particularly limited in any of the embodiments of this invention. All that is required is that at least one pant connecting strip 135 and at least one shirt connecting 235 are present. Furthermore, the position of the pant connecting strips 135 around the waistband 130 and the position of the shirt connecting strips around the waistzone 230 is not particularly limited. The pant connecting strips 135 may be located only on the front side 110, or only on the back side 115, or may be aligned on both the front side 110 and the back side 115 in either a symmetrical or nonsymmetrical manner. Similarly, the shirt connecting strips 235 may be located only on the front side 210, or only on the back side 215, or may be aligned on both the front side 210 and the back side 215 in either a symmetrical or nonsymmetrical manner. However, certain numbers and arrangements of pant connecting strips 135 and shirt connecting strips 235 are preferred.

It is preferred that the total number of pant connecting strips 135 be equal to the total number of shirt connecting strips 235 to avoid waste since one of each type of strip is necessary to form a self-releasing bond 300.

It is also preferred that the pair of pants 100 is made to fit a wearer of a given pant size and that the shirt 200 is made to fit a wearer of a given shirt size and that both garments are marked identifying their respective sizes. The pant connecting strips 135 and shirt connecting strips 235 are then positioned in a corresponding fashion to naturally align and contact to form the self-releasing bonds 300 when the pair of pants 100 and the shirt 200 are worn by a wearer whose pant size and shirt size matches the pant size and the shirt size indicated on the respective garments.

To balance fastening strength and flexibility, the preferred embodiment has the following characteristics:

i) the number of pant connecting strips 135 and the number of shirt connecting strips 235 are three apiece;

ii) the three pant connecting strips 135 include two front pant connecting strips 135' that are located on the front side 110 of the pair of pants 100 and one back pant connecting strips 135" that is located on the back side 115 of the pair of a pants 100, and the three shirt connecting strips 235 include two front shirt connecting strips 235' that are located on the front side 210 of the shirt 200 and one back shirt connecting strip 235" that is located on back side 215 of the shirt 200. To optimally balance fastening strength and flexibility, the invention preferably meets the following criteria:

i) the number of pant connecting strips 135 and the number of shirt connecting strips 235 are three apiece;

ii) the three pant connecting strips 135 include two front pant connecting strips 135' that are symmetrically located with respect to a central vertical axis 140 on the front side 110 of the pair of pants 100, are about 1" wide apiece, are one twelfth to one half, preferably one sixth to one twelfth, and most preferably one ninth as long as the waistband 130, and are separated from one another by a distance that is one half to one twelfth, preferably one third to one ninth, most preferably one sixth as long as the waistband 130;

iii) the three pant connecting strips 135 include one back pant connecting strip 135" that is centrally located with respect to a central vertical axis on the rear side 115 of the pair of pants 100, is about 1" wide, and is at least 1/12th, preferably at least 1/6th and most preferably at least 1/6th as long as the waistband 130;

iv) the three shirt connecting strips 235 include two front shirt connecting strips 235' that are symmetrically located with respect to a central vertical axis 140 on the front side 210 of the shirt 100 and are of corresponding width, length, and separation to the first and second pant connecting strips 135; and v) the three shirt connecting strips 235 include one back shirt connecting strip 235" is centrally located with respect to a central vertical axis 140 on the rear side 215 of the shirt 200 and is of corresponding width and length to the third pant connecting strip 135.

If the wearer is engaged in any activity that requires frequent bending, such as playing golf, then a preferred embodiment utilizes pant connecting strips 135 located solely on the sides of the pair of pants 100 and shirt connecting strips 235 located solely on the sides of the shirt 200. In this manner the amount of shear and torque exerted against the self-releasing bonds as a result of bending, and bending and twisting, respectfully, is minimized.

Figure 7:
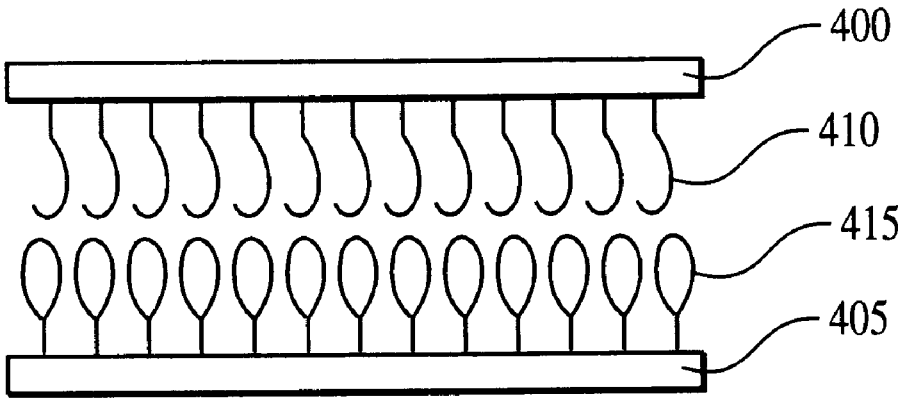
FIG. 7 shows the primary components in a hook and loop fastener.
Figure 8:
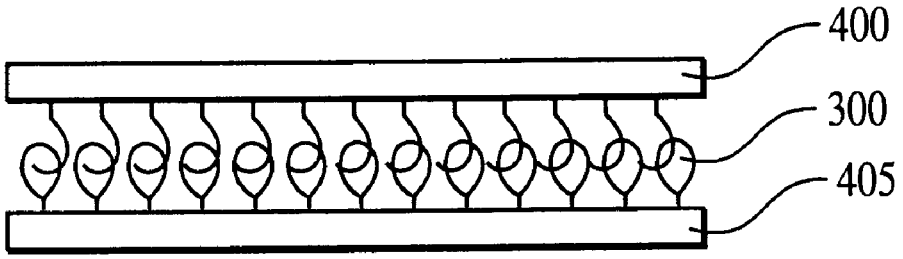
FIG. 8 shows the self-releasing bond formed by contacting a hook strip to a loop strip.

FIG. 7 shows a hook strip 400 comprising hooks 410 located on one side of the hook strip 400, and a loop strip 405 comprising loops 415 located on one side of the loop strip 405. The hook strip 400 and the loop strip 405, in combination, form what is known in the art as a "hook and loop fastener" or a "touch fastener." Hook and loop fasteners are the preferred connecting means for forming the self-releasing bonds 300 in the instant invention. When the hooks 410 on the hook strip 400 and the loops 415 on the loop strip 405 are contacted, as demonstrated in FIG. 8, a self-releasing bond 300 is formed. Various hook and loop fasteners are commercially available under numerous trademarks, the most commonly known being VELCRO™.

Hook and loop are made from the clothing materials such as nylon and/or polyester and create strong bonds using very small amounts of material.

Figure 9:
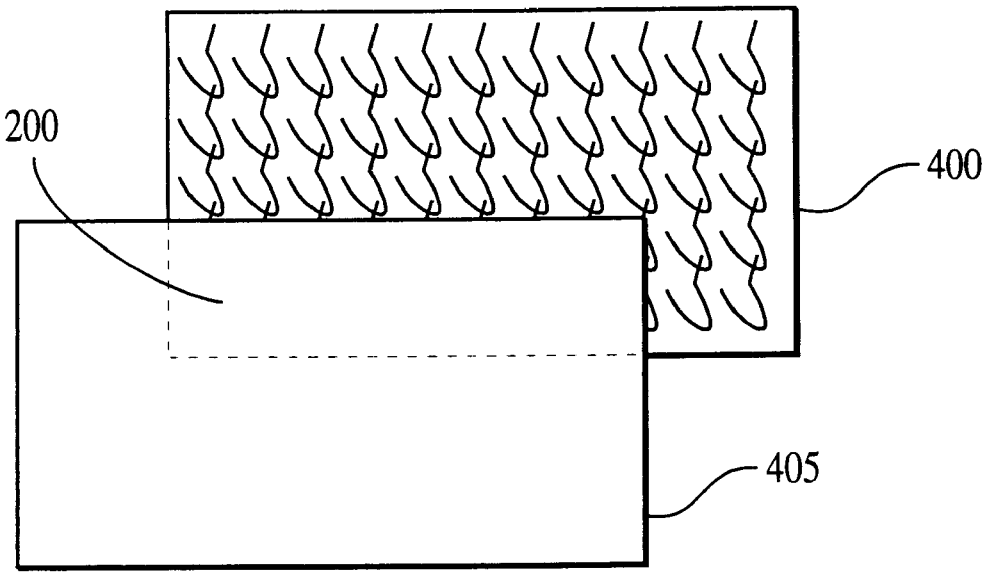
FIG. 9 is a representation of the adjustable bond formed by contacting a hook strip to a loop strip.

As demonstrated by FIG. 9 hook and loop fasteners are adjustable. In FIG. 9, a hook strip 400 is overlapped by a loop strip 405. The overlapping surface area 300 can be varied in size and location simply by moving one strip relative to the other. Therefore, if any hindrance occurs to the movement of the wearer, the fastener can be adjusted to minimize the hindrance.

Most importantly, the bonds provided by hook and loop fasteners self-release in a reusable manner when subjected to a force that below the tensile and/or shearing force required to tear the pair of pants 100 or the shirt 200. Typical hook and loop fasteners have a tensile strength between 4 psi and 34 psi and a longitudinal shear strength between 5 psi and 40.5 psi.

However, small vibrational forces do not break the bond of a hook and loop fastener. In fact, such light shaking causes the hooks to move deeper into the loops and actually improves the bond of hook and loop fastener.

In addition, hook and loop fasteners are generally made of water resistant and chemical resistant materials such as nylon and/or polyester that are dyeable using conventional clothing dyes.

Utilizing hook and loop fasteners, a shirt can be tucked taught inside a pair of pants without creping out and requiring retucking. The hook and loop fasteners, because they are sewn into the clothing can be firmly affixed above the waistline at or near the belly button to enable a wearer to present a neat appearance that, simultaneously, hides physical imperfections such as an expansive stomach.

It is envisioned, and certainly embraced by this invention, that a entire clothing line of pants 100 containing pant connecting strips 135 and shirts 200 containing shirt connecting strips 235 can be created. The wearer can mix and match from a variety of styles and sizes of both pants 100 and shirts 200 to create an entire wardrobe wherein each pair of pants 100 is capable of forming self-releasing bonds with each shirt 200.

Figure 10A:
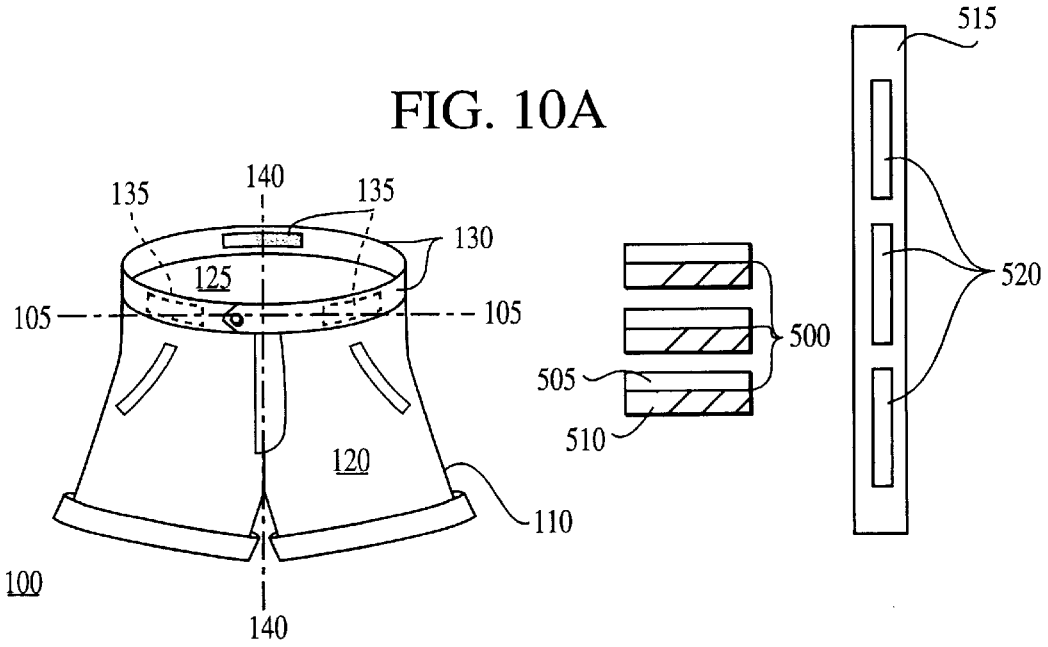
FIG. 10 is a schematic of the primary components of a first kit comprising a pair of pants or a shirt, three unattached connecting strips and a template.
Figure 10B:
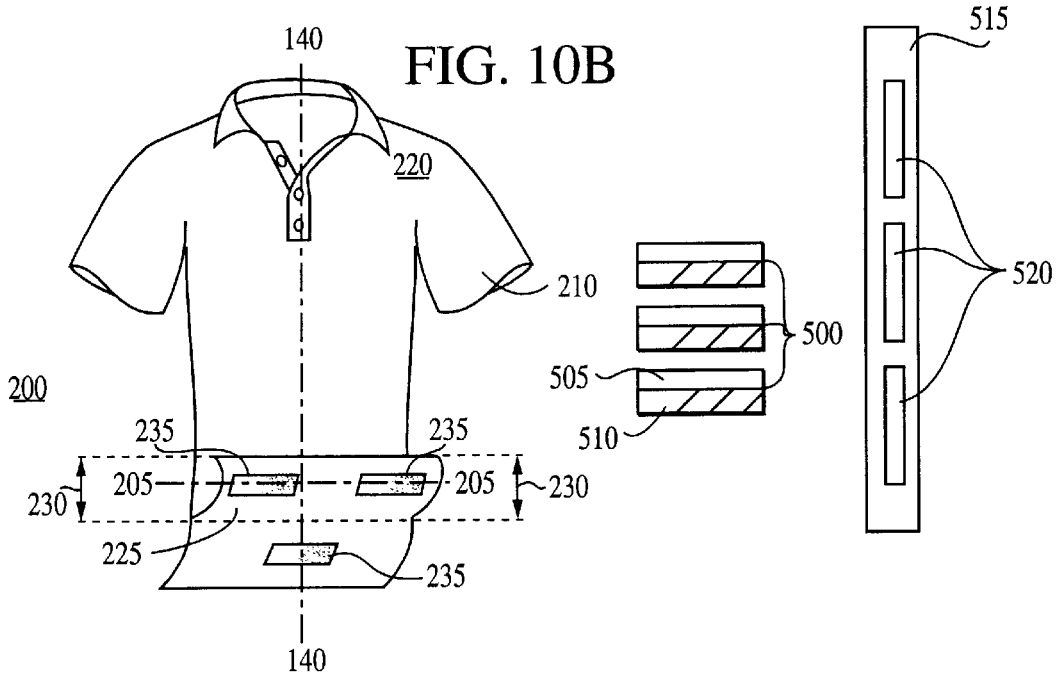

FIG. 10 shows a multicomponent kit for making a clothing combination embraced by this invention. The kit comprises: (i) a pair of pants 100 or, alternatively, a shirt 200, (ii) one or more unaffixed connecting strips 500; and, optionally, (iii) one or more templates 520.

The pair of pants 100, if present, is chosen from any of the pair of pants 100 previously described in this application. The pair of pants 100 has a front side 110, a back side 115, an outer surface 120, an inner surface 125, a waistline 105 and a waistband 130. One or more pant connecting strips 135 are located within the area that defines the waistband 130.

The shirt 200, if present, is chosen from any of the shirts 200 previously described in this application. The shirt 200 has a front side 210, a back side 215, an outer surface 220, an inner surface 225, a waistline 205 and a waist zone 230. One or more shirt connecting strips 235 are located within the area that defines the waist zone 230.

The unaffixed connecting strips 500 contain a connecting layer 505 and an adherent backing 510 that is capable of binding the unaffixed connecting strips 500 to the pair of pants 100 or the shirt 200. Although the number of unaffixed connecting strips 500 in FIG. 10 is three, the number is not limited as long as it is equal to or greater than the number of affixed pant connecting strips 135 or affixed shirt connecting strips 235. Preferably, to avoid waste, the number of unaffixed connecting strips 500 is equal to the number of affixed pant connecting strips 135 or affixed shirt connecting strips 235.

The optional template 515 comprises one or more markings or openings 520. The markings or openings 520 on the template 515 illustrate the positions for bonding one or more of the affixed connecting strips 500 to the pair of pants 100 when the template 515 is properly aligned. In addition, or alternatively, the markings or openings 520 on the template 515 illustrate positions for binding one or more of the unaffixed connecting strips 500 to the shirt 200 when the template 515 is properly aligned. Proper alignment of the template 515 on a pair of pants 100 requires that the template 515 be placed horizontally across the pair of pants 100 parallel to the pant waistline 105 within the waistband 230. Generally, placing the template 515 parallel with the upper rim of the pair of pants immediately above any pockets and zippers will meet this limitation. Proper alignment of the template 515 on a shirt 200 requires that the template 515 be placed horizontally across the shirt 200 parallel to the shirt waistline 205 within the waist zone 230. Generally, placing the template 515 parallel and a few inches above the lower edge of the shirt, at point where the shirt would first begin to overlap most pairs of pants worn by the wearer, will meet this limitation.

Spare unaffixed connecting strips 500 may be provided in the kit in case of errors in affixing the strips.

The unaffixed connecting strips 500 are bonded to the pair of pants 100 or shirt 200 through the adherent backing 510. This backing may be sewn onto the pair of pants 100 or the shirt 200. Preferably, however, as the name implies, the backing is adhered onto the pair of pants 100 or the shirt 200 by means of an adhesive contained thereon. Acceptable adhesives include pressure sensitive adhesives, heat sensitive adhesives, light activated adhesives, two component adhesives and moisture sensitive adhesives.

When the pant connecting strips or the shirt connecting strips are placed into contact with the unaffixed connecting strip they form a self-releasing bond. Preferably, each self-releasing bond 300 has a tensile strength between 4 psi and 34 psi and a longitudinal shear strength between 5 psi and 40.5 psi.

The pant connecting strips 135, the shirt connecting strips 235, and the unaffixed connecting strips 500, are preferably hook and loop strips to a hook and loop fastener. As already stated, hook and loop fasteners provide flexibility due to their composition, size and adjustability, provide self-release, vibrational strength, water and chemical resistance, and can be dyed using conventional clothing dyes. To make a functional hook and loop fastener, whenever the pant connecting strips 135 or shirt connecting strips 235 are hook strips, the corresponding unaffixed connecting strips are loop strips and visa versa.

Figure 11:
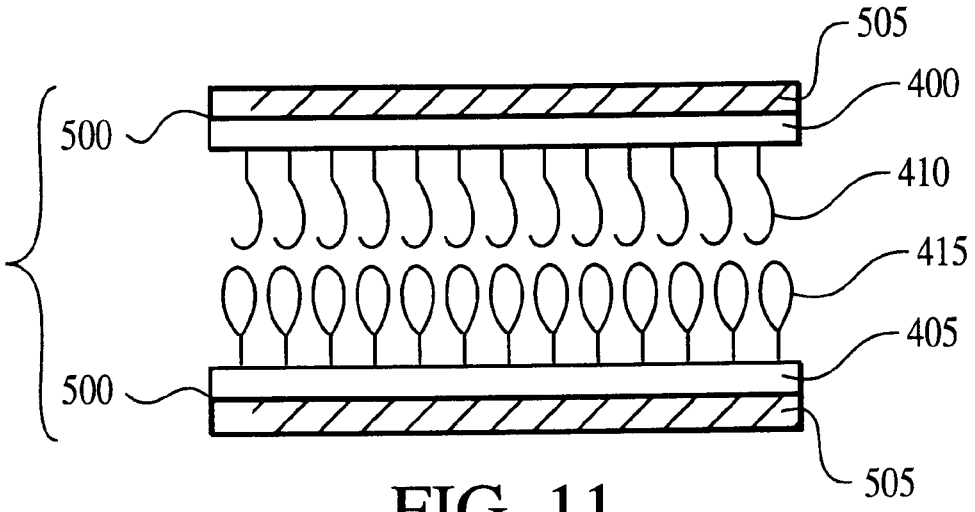
FIG. 11 is a diagram of an adherent hook strip and an adherent loop strip.

FIG. 11 shows a preferred unaffixed connecting strip 500. The unaffixed connecting strip 500 has an adherent backing 505 capable of binding the unaffixed connecting strip to a pair of pants 100 or a shirt 200. The adherent backing 505 contains an adhesive, such as a pressure sensitive adhesive, a heat activated adhesive, a light activated adhesive, a moisture sensitive adhesive and a two component adhesive. Located immediately on top of the adherent backing 505 is a hook strip 400 that comprises hooks 410 or a loop strip 405 that comprises loops 415.

Figure 12B:
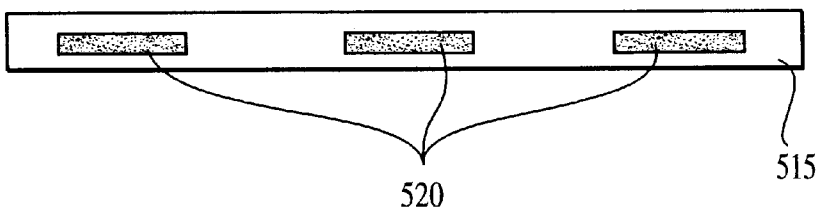
FIG. 12 is a schematic of the primary components of a second kit comprising three hook strips, three adherent loop strips, and a template.
Figure 12A:
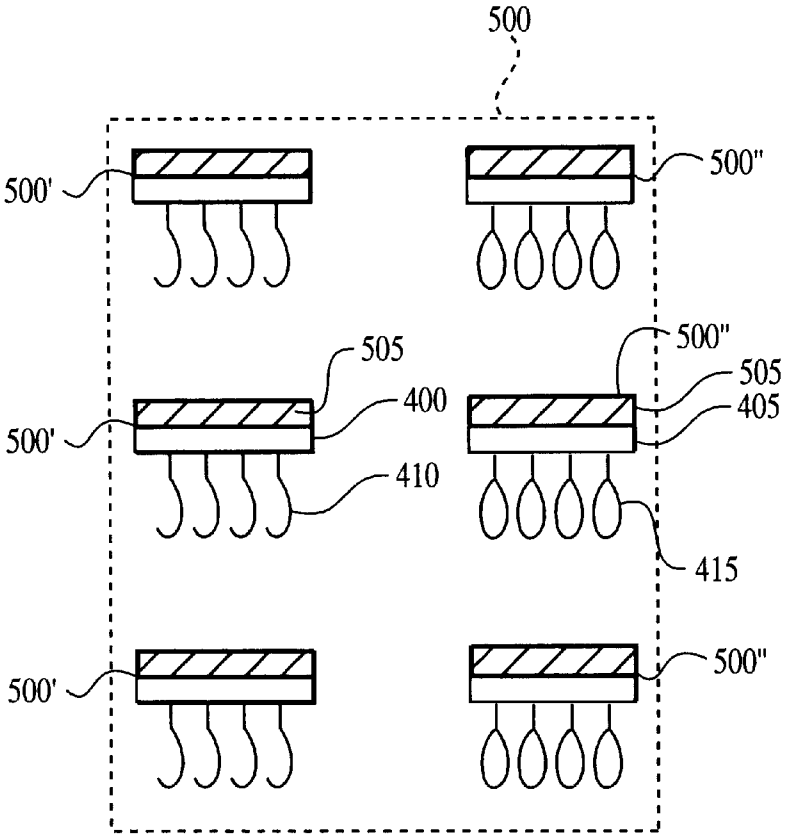

FIG. 12 illustrates a second multicomponent kit for making a clothing combination embraced by this invention. The kit comprises: (i) at least one first unaffixed connecting strip 500' that comprises (a) a hook strip 400 that comprising hooks 410 for a hook and loop fastener and (b) an adherent backing 505 capable of binding to a pair of pants 100 or a shirt 200; (ii) at least one second unaffixed connecting strip 500" that comprises: (a) a loop strip 405 comprising loops 415 for a hook and loop fastener, and (b) an adherent backing 505 capable of binding to a pair of pants 100 or a shirt 200; and (iii) a template 515 containing markings 520 thereon or therein that, illustrate positions for bonding one or more of the first and second unaffixed connecting strips 500 to the pair of pants 100 when placed parallel to the pant waistline 105 within the waistband 130 and/or illustrate positions for binding one or more of the first and second unaffixed connecting strips 500 to the shirt 200 when placed parallel to the shirt waistline 205 within the waist zone 230. This kit may be boxed or wrapped in a variety of ways and sold in stores.

Figure 13:
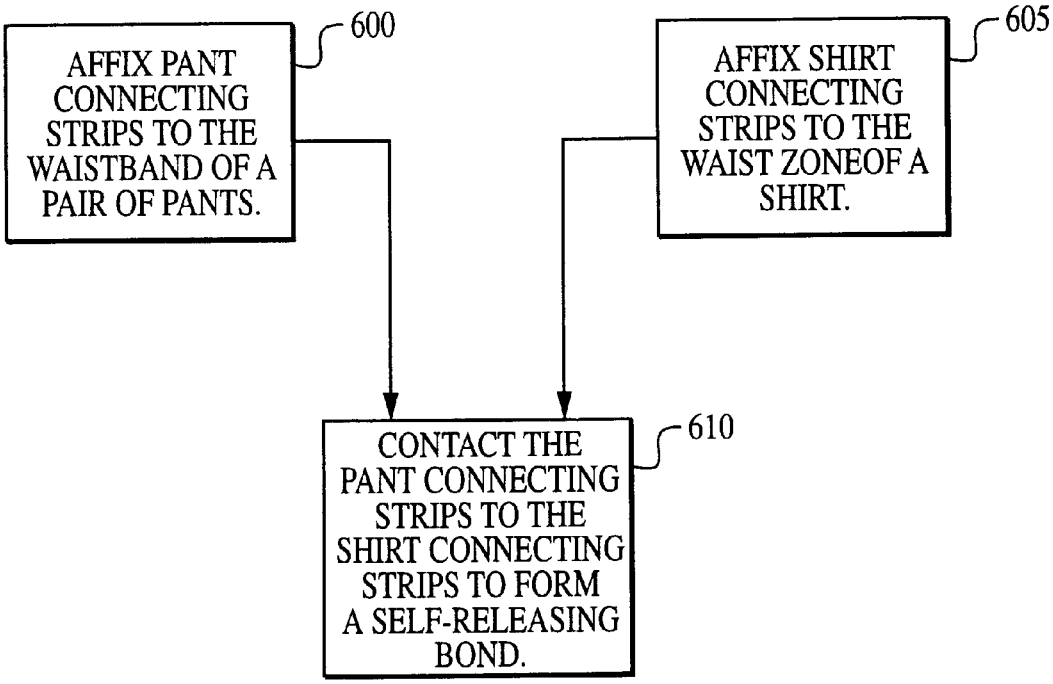
FIG. 13 is a chart outlining the steps for affixing a shirt to a pair of pants by means of a self-releasing bond.

FIG. 13 diagrams a process for making the clothing combinations of the instant invention. The process comprises a first step 600 wherein pant connecting strips are affixed to the waistband area of a pair of pants. In a second step, shirt connecting strips are affixed to the waistzone of a shirt. The first and second steps may be 605 reversed or carried out concurrently. In a third step 610, the pant connecting strips are contacted with the shirt connecting strips to form a self-releasing bond.

Preferably, to ensure proper positioning of the pant connecting strips onto the pair of pants and the shirt connecting strips onto the shirt, one or more templates is used. A template comprises one or more openings therein or markings thereon. The markings or openings on the template illustrate the positions for bonding one or more of the pant connecting strips when the template is placed parallel to the pant waistline within the waistband. In addition, or alternatively, the markings or openings on the template illustrate positions for binding one or more of the shirt connecting strips to the shirt when the template is placed parallel to the shirt waistline within the waist zone.

The pant connecting strips and shirt connecting strips in this process are made from a noncorrosive material that can be dyed with conventional clothing dyes. Such materials include nylon and/or polyester.

The self releasing bond in this process is adjustable by manipulating the size and location of the surface area wherein the pant connecting strips and the shirt connecting strips come into contact. However, it is preferred that the surface area wherein the pant connecting strips and the shirt connecting strips come into contact remains at its maximum. Lowering the surface area naturally lowers the strength of the bond. However, lowering the surface area does not affect the self-releasing nature of the bond.

When the pair of pants is made to fit a wearer with a given pant size and the shirt is made to fit a wearer of a given shirt size and each garment is marked accordingly, the pant connecting strips and shirt connecting strips naturally align and come into contact to form the self-releasing bonds whenever the pair of pants and the shirt are worn by a wearer whose pant size and shirt size matches the pant size and shirt size indicated on the markers.

Preferably, the number, size, ratio and positioning of the pant connecting strips and shirt connecting strips used in this process are identical to the preferences discussed previously in this application with regard to the clothing combination embodiments.

Ideally, the pant connecting strips are hook strips and shirt connecting strips are loop strips, or visa versa, so that the pant connecting strips and shirt connecting strips combine to form one or more hook and loop fasteners. As already stated, hook and loop fasteners provide flexibility due to their composition, size and adjustability, and also provide self-release, vibrational strength, water and chemical resistance, and can be dyed using conventional clothing dyes.

What is claimed is:

1. A clothing combination to be worn by a wearer comprising:

(i) a pair of pants having a front side and a back side, an inner surface and an outer surface, and a pant waistline, said pair of pants comprising:

(a) a waistband which encompasses the entire pant waistline and a region that starts approximately 3" above the pant waistline and ends approximately 1.5" below the pant waistline; and (b) three pant connecting strips affixed to the waistband wherein two of the pant connecting strips are located on the front side of the pair of pants and one of the pant connecting strips is located on the back side of the pair of pants; and (ii) a shirt having a front side and a back side, an inner surface and an outer surface, and a shirt waistline, said shirt comprising:

(c) a waist zone which encompasses the entire shirt waistline and a region that starts approximately 3" above the shirt waistline and ends approximately 1.5" below the shirt waistline; and (d) three shirt connecting strips affixed to the waist zone wherein two of the shirt connecting strips are located on the front side of the shirt and one of the shirt connecting strips is located on the back side of the shirt, wherein the pants and the shirt are connected, or capable of being connected, through a self-releasing bond that is formed whenever said pant connecting strips are brought into contact with said shirt connecting strips.

2. The clothing combination of claim 1 wherein the self-releasing bond increases in strength when subjected to one or more vibrational forces but releases automatically when subjected to any force below the tensile strength of both the pair of pants and the shirt and releases automatically when subjected to a force below the shear strength of both the pair of pants and shirt.

3. The clothing combination of claim 1 wherein the self-releasing bond has a tensile strength between 4 psi and 34 psi and a longitudinal shear strength between 5 psi and 40.5 psi.

4. The clothing combination of claim 1 wherein both the pant connecting strips and shirt connecting strips comprise a noncorrosive material.

5. The clothing combination of claim 4 wherein the shirt connecting strips comprise a dyeable material.

6. The clothing combination of claim 5 wherein both the pant connecting strips and shirt connecting strips comprise a material selected from the group consisting of nylon, polyester, and a mixture thereof.

7. The clothing combination of claim 1 wherein the self-releasing bond is adjustable.

8. The clothing combination of claim 7 wherein the self-releasing bond is adjustable by manipulating the size and location of the surface area wherein the pant connecting strips and shirt connecting strips contact.

9. The clothing combination of claim 1 wherein each of the pant connecting strips comprises hooks and each of the shirt connecting strips comprises loops so that the pant connecting strips and shirt connecting strips form one or more hook and loop fasteners.

10. The clothing combination of claim 1 wherein the pant connecting strips are loop strips and the shirt connecting strips are hook strips for a hook and loop fastening system.

11. The clothing combination of claim 1 wherein the pant connecting strips are affixed to the inner surface of the pair of pants and the shirt connecting strips are affixed to the outer surface of the shirt thereby allowing the shirt to be bonded to the pair of pants in a tucked position.

12. The clothing combination of claim 1 wherein the pair of pants is made to fit a wearer of a given pant size and the shirt is made to fit a wearer of a given shirt size, wherein the pair of pants and shirt both comprise at least one or more markers identifying the size, and wherein the pant connecting strips and the shirt connecting strips naturally align and come into contact to form the self-releasing bond when the pair of pants and the shirt are worn by a wearer whose pant size and shirt size matches the pant size and shirt size indicated on the markers.

13. The clothing combination of claim 1 wherein the following criteria are met:

i) the number of pant connecting strips and the number of shirt connecting strips are three apiece;

ii) the three pant connecting strips include two front pant connecting strips that are symmetrically located with respect to a central vertical axis on the front side of the pair of pants, are about 1" wide apiece, are one twelfth to one half as long as the waistband, and are separated from one another by a distance that is one half to one twelfth as long as the waistband;

iii) the three pant connecting strips include one back pant connecting strip that is centrally located with respect to a central vertical axis on the rear side of the pair of pants, is about 1" wide, and is at least 1/12th as long as the waistband;

iv) the three shirt connecting strips include two front shirt connecting strips that are symmetrically located with respect to a central vertical axis on the front side of the shirt and are of corresponding width, length, and separation to the first and second pant connecting strips; and v) the three shirt connecting strips include one back shirt connecting strip is centrally located with respect to a central vertical axis on the rear side of the shirt and is of corresponding width and length to the third pant connecting strip.

14. A multicomponent kit for making a clothing combination to be worn by a wearer consisting essentially of:

(i) a garment selected from the group consisting of a pair of pants and shirt wherein (i1) the pair of pants, if selected, has a front side and a back side, an inner surface and an outer surface, and a pant waistline, said pair of pants comprising:

(a) a waistband which encompasses the entire pant waistline and a region that starts approximately 3" above the pant waistline and ends approximately 1.5" below the pant waistline; and (b) one or more pant connecting strips affixed to the waistband; and (i2) the shirt, if selected, has a front side and a back side, an inner surface and an outer surface, and a shirt waistline, said shirt comprising:

(c) a waist zone which encompasses the entire shirt waistline and a region that starts approximately 3" above the shirt waistline and ends approximately 1.5" below the shirt waistline; and (d) one or more shirt connecting strips affixed to the waist zone; and (ii) one or more unaffixed connecting strips containing an adherent backing for binding the unaffixed connecting strips to a pair of pants or to a shirt, wherein the number of unaffixed strips is equal to the number of affixed pant connecting strips or affixed shirt connecting strips.

15. The multicomponent kit of claim 14 wherein the kit comprises a pair of pants with affixed pant connecting strips and further comprises one or more unaffixed connecting strips, wherein each of the affixed pant connecting strips comprises hooks and each of the unaffixed connecting strips comprises loops so that the pant connecting strips and the unaffixed connecting strips, when contacted together, form one or more hook and loop fasteners.

16. The multicomponent kit of claim 14 wherein the kit comprises a pair of pants with affixed pant connecting strips and further comprises one or more unaffixed connecting strips, wherein each of the affixed pant connecting strips comprises loops and each of the unaffixed connecting strips comprises hooks so that the pant connecting strips and the unaffixed connecting strips, when contacted together, form one or more book and loop fasteners.

17. The multicomponent kit of claim 14 wherein the kit comprises a shirt with affixed shirt connecting strips and further comprises one or more unaffixed connecting strips, wherein each of the affixed shirt connecting strips comprises hooks and each of the unaffixed connecting strips comprises loops so that the shirt connecting strips and the unaffixed connecting strips, when contacted together, form one or more hook and loop fasteners.

18. The multicomponent kit of claim 14 wherein the kit comprises a shirt with affixed shirt connecting strips and further comprises one or more unaffixed connecting strips, wherein each of the affixed shirt connecting strips comprises loops and each of the unaffixed connecting strips comprises hooks so that the shirt connecting strips and the unaffixed connecting strips, when contacted together, form one or more hook and loop fasteners.

19. A multicomponent kit for making a clothing combination to be worn by a wearer comprising:

(i) at least one first unaffixed connecting strip that contains (a) a hook strip comprising hooks for a book and loop fastener, and (b) an adherent backing capable of binding to a pair of pants or to a shirt;

(ii) at least one second unaffixed connecting strip that contains (a) a loop strip for a hook and loop fastener, and (b) an adherent backing capable of binding the loop strip to a pair of pants or to a shirt;

(iii) a template containing markings thereon or therein that illustrates positions for bonding one or more of the first or second unaffixed connecting strips to the pair of pants when place parallel to the pant waistline within the waistband, and/or when illustrates positions for binding one or more of the first or second unaffixed connecting strips to the shirt when placed parallel to the shirt waistline within the waist zone.

20. The multicomponent kit of claim 19 wherein the template illustrates positions for bonding one or more of the first and second unaffixed connecting strips to the pair of pants.

21. The multicomponent kit of claim 19 wherein the template illustrates positions for bonding one or more of the first and second unaffixed connecting strips to the shirt.

22. The multicomponent kit of claim 19 wherein the template illustrates positions for bonding one or more of the first and second unaffixed connecting strips to the pair of pants and illustrates positions for bonding one or more of the first and second unaffixed connecting strips to the shirt.

23. The multicomponent kit of claim 19 wherein the kit comprises a first template that illustrates positions for bonding one or more of the first and second unaffixed connecting strips to the pair of pants, and a second template that illustrates positions for bonding one or more of the first and second unaffixed connecting strips to the shirt.

24. A method for bonding multiple components of a clothing combination which comprises the following steps:

(i) selecting a pair of pants having a pant waistline, a front side and a back side, and an inner surface and an outer surface, said pair of pants comprising a waistband which encompasses the entire pant waistline and a region that starts approximately 3" above the pant waistline and ends approximately 1.5" below the pant waistline;

(ii) affixing to said waistband three pant connecting strips wherein two of the pant connecting strips are located on the front side of the pair of pants and one of the pant connecting strips is located on the back side of the pair of pants;

(iii) selecting a shirt having a shirt waistline, a front side and a back side, and an inner surface and an outer surface, said shirt comprising a waist zone which encompasses the entire shirt waistline and a region that begins approximately 3" above the shirt waistline and ends approximately 1.5" below the shirt waistline;

(iv) affixing to said waistzone three shirt connecting strips wherein two of the shirt connecting strips are located on the front side of the shirt and one of the shirt connecting strips is located on the back side of the shirt;

(v) contacting said pant connecting strips with said shirt connecting strips to form a self-releasing bond.

25. The method of claim 24 wherein the self-releasing bond increases in strength when subjected to one or more vibrational forces but releases automatically when subjected to any force below the tensile strength of both the pair of pants and the shirt and releases automatically when subjected to a force below the shear strength of both the pair of pants and the shirt.

26. The method of claim 24 wherein the self-releasing bond has a tensile strength between 4 psi and 34 psi and a longitudinal shear strength between 5 psi and 40.5 psi.

27. The method of claim 24 wherein both the pant connecting strips an shirt connecting strips comprise a noncorrosive material.

28. The method claim 27 wherein the shirt connecting strips comprise a dyeable material.

29. The method of claim 28 wherein both the pant connecting strips and shirt connecting strips comprise a material selected from the group consisting of nylon, polyester, and a mixture thereof.

30. The method of claim 27 wherein the self-releasing bond is adjustable.

31. The method of claim 30 wherein the self-releasing bond is adjustable by manipulating the size and location of the surface area wherein the pant connecting strips and shirt connecting strips contact.

32. The method of claim 24 wherein each of the pant connecting strips comprise hooks and each of the shirt connecting strips comprise loops so that the pant connecting strips and shirt connecting strips form one or more hook and loop fasteners.

33. The method of claim 24 wherein the pant connecting strips are loop strips and the shirt connecting strips are hook strips for a hook and loop fastening system.

34. The method of claim 24 wherein the pant connecting strips are affixed to the inner surface of the pair of pants and the shirt connecting strips are affixed to the outer surface of the shirt thereby allowing the shirt to be bonded to the pair of pants in a tucked position.

35. The method of claim 24 wherein the pair of pants is made to fit a wearer of a given pant size and the shirt is made to fit a wearer of a given shirt size, wherein the pair of pants and shirt both comprise at least one or more markers identifying the size, and wherein the pant connecting strips and the shirt connecting strips naturally align and come into contact to form the self-releasing bond when the pair of pants and the shirt are worn by a wearer whose pant size and shirt size matches the pant size and shirt size indicated on the markers.

36. The method of claim 33 wherein i) the number of pant connecting strips and the number of shirt connecting strips are three apiece;

ii) the three pant connecting strips include two front pant connecting strips that are symmetrically located with respect to a central vertical axis on the front side of the pair of pants, are about 1" wide apiece, are one twelfth to one half as long as the waistband, and are separated from one another by a distance that is one half to one twelfth as long as the waistband;

iii) the three pant connecting strips include one back pant connecting strip that is centrally located with respect to a central vertical axis on the rear side of the pair of pants, is about 1" wide, and is at least 1/12th as long as the waistband;

iv) the three shirt connecting strips include two front shirt connecting strips that are symmetrically located with respect to a central vertical axis on the front side of the shirt and are of corresponding width, length, and separation to the first and second pant connecting strips; and v) the three shirt connecting strips include one back shirt connecting strip is centrally located with respect to a central vertical axis on the rear side of the shirt and is of corresponding width and length to the third pant connecting strip.

* * * * *